US010208766B2

(12) United States Patent
Boffelli

(10) Patent No.: US 10,208,766 B2
(45) Date of Patent: Feb. 19, 2019

(54) PRE-ASSEMBLED BLADE FOR FANS FOR COOLING THE COOLANT IN MACHINES/VEHICLES AND FAN PROVIDED WITH SAID BLADE

(71) Applicant: Piercarlo Boffelli, Tribiano (IT)

(72) Inventor: Piercarlo Boffelli, Tribiano (IT)

(73) Assignee: BARUFFALDI S.P.A., Tribiano (MI) (IT)

( * ) Notice: Subject to any disclaimer, the term of this patent is extended or adjusted under 35 U.S.C. 154(b) by 0 days.

(21) Appl. No.: 15/549,397

(22) PCT Filed: Feb. 10, 2016

(86) PCT No.: PCT/EP2016/052834
§ 371 (c)(1),
(2) Date: Aug. 8, 2017

(87) PCT Pub. No.: WO2016/128469
PCT Pub. Date: Aug. 18, 2016

(65) Prior Publication Data

US 2018/0038383 A1 Feb. 8, 2018

(30) Foreign Application Priority Data

Feb. 12, 2015 (IT) ..... MI2105A0195

(51) Int. Cl.
*F04D 29/36* (2006.01)
*F04D 29/66* (2006.01)
*F04D 29/64* (2006.01)

(52) U.S. Cl.
CPC ..... *F04D 29/362* (2013.01); *F04D 29/646* (2013.01); *F04D 29/668* (2013.01)

(58) Field of Classification Search
CPC ..... F04D 29/362; F04D 29/646; F04D 29/668
See application file for complete search history.

(56) References Cited

U.S. PATENT DOCUMENTS 2,154,199 A * 4/1939 Colwell ..... F04D 29/126 277/399
3,420,311 A 1/1969 Davies
(Continued)

FOREIGN PATENT DOCUMENTS

GB 843066 A 8/1960
JP S58135399 A 8/1983

OTHER PUBLICATIONS

IPRP for PCT/EP2016/052834, dated Aug. 15, 2017, 6 Pages.

*Primary Examiner* — Woody A Lee, Jr.

(57) ABSTRACT

Pre-assembled blade (20) for fans (10) for cooling the coolant contained inside the radiator (1) of operating machines and/or vehicles, comprising a blade body (20*a*) rigidly connected to an axial shank (21), a part of which situated radially on the outside of the blade body is in the form of a cylindrical pin (21*b*); wherein the shank (21) has a part axially on the outside of the blade body in the form of a cylindrical pin (21*b*), holes (21*c*) with internal female threading being formed inside the pin (21*b*); and in that the blade (20) comprises —a blade flange (22) comprising. a hollow cylindrical body (22*a*), the opposite end bases of which comprise respectively: a flat edge (22*b*) provided with through-holes (22*c*). an inset annular seat (22*d*); a disk (23) provided with through-holes (23*a*) and an eccentric recess (23*d*) for stably containing with friction a pin (24) which is also eccentric, for rotationally actuating the blade about its axis; —screws (25) designed to pass through the through-holes (23*a*) in the disk (23) and mate with the female thread of the holes (21*c*) in the pin (21*b*) in order to fix relative to each other the disk (23), flange (22) and pin (21*b*), thus ensuring a definite angular alignment of the blade relative to the pin (24) during pre-assembly.

10 Claims, 3 Drawing Sheets

(56) References Cited

U.S. PATENT DOCUMENTS

Figure 1:
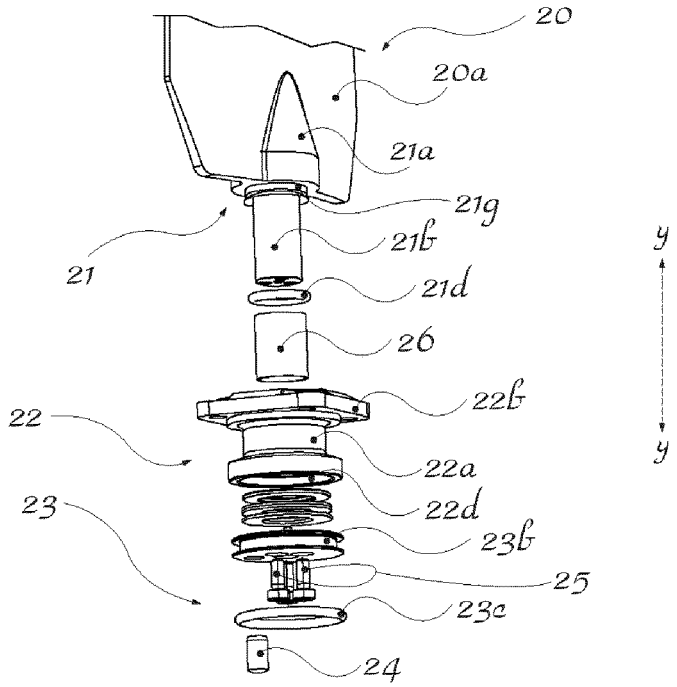

| | | | | | |
|---|---|---|---|---|---|
| 6,007,303 | A * | 12/1999 | Schmidt | ..... | H02K 49/104<br>123/41.47 |
| 2014/0041181 | A1 * | 2/2014 | Ubukata | ..... | B23Q 3/063<br>29/402.01 |

* cited by examiner

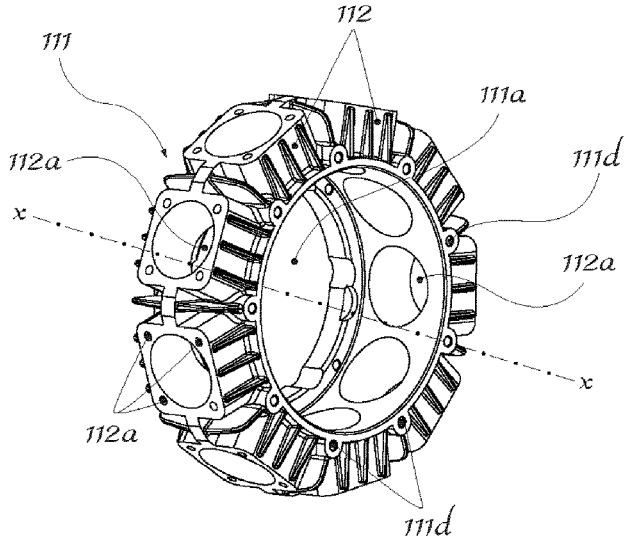
Fig. 4
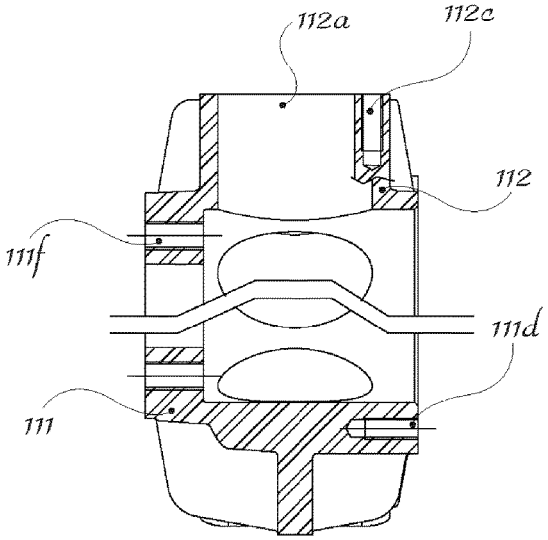
Fig. 5
Fig. 7
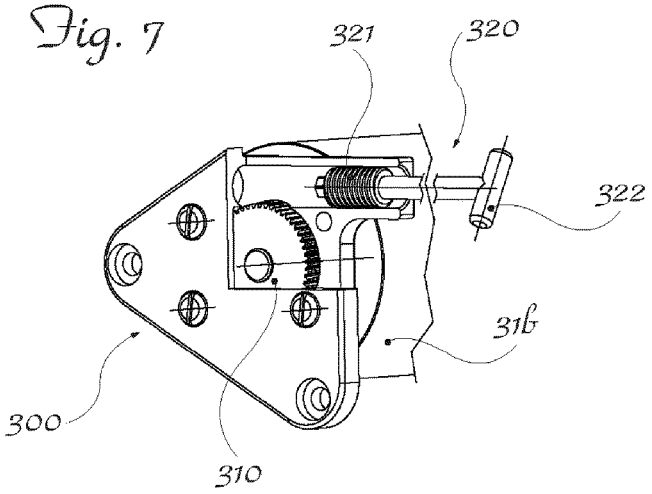

PRE-ASSEMBLED BLADE FOR FANS FOR COOLING THE COOLANT IN MACHINES/VEHICLES AND FAN PROVIDED WITH SAID BLADE

The present invention relates to a blade for fans for cooling the coolant contained in the radiator of operating machines and/or vehicles, in particular agricultural tractors and off-road vehicles, and to an apparatus for actuating and controlling the rotation of the fan blades about their axis.

It is known that the driving of operating machines and vehicles by means of a heat engine involves the need to cool the latter by means of a coolant which is stored inside a cellular radiator and recirculated through the engine; the coolant is in turn cooled by the ambient air which is forced to pass through the radiator by the sucking action of a rotating fan.

Taking as a reference point the normal front part of the machine/vehicle the three elements are axially arranged with the radiator at the front, engine behind it and fan arranged between the two.

It is also known that, in the technical sector of vehicles which are generally used in conditions where there is a large quantity of loose debris, as in the case of agricultural tractors or vehicles intended for off-road use, but also operating machines which work under stationary conditions, this loose debris tends to get deposited on the cellular surfaces of the radiator containing the vehicle coolant, causing blockage thereof and therefore a reduced and/or no cooling of the fluid, with consequent overheating of the engine.

It is also known that the main cause of said accumulation of debris on the radiator is the forced air flow of the fan which is arranged behind the radiator in the direction of travel of the vehicle and connected to the driving shaft of the vehicle, said fan, when rotated, drawing in the air and forcing it to pass through the radiator, causing heat dissipation from the coolant contained therein, which is at a higher temperature, into the external environment, which is at a lower temperature.

It is also known that, under normal operating conditions, said fan must be made to rotate only when a certain predefined temperature of the coolant is reached, this being detected by means of a thermostat.

In greater detail it is required that a motor vehicle fan should be able to draw air from the radiator towards the heat engine:

- in a small amount for cooling in low external temperature conditions,
- in large amounts when there are higher external temperatures or when the vehicle is used in demanding conditions resulting in overheating of the engine, but also

- air must be temporarily forced onto the radiator in the opposite direction in order to clean it of the impurities which have accumulated during normal operation.

In order to determine these operating conditions, fan actuating apparatus able to produce controlled rotation of the fan blades from a condition for suction of the air from the radiator into a condition for propelling air onto the radiator are known in the art, whereby it also envisaged that in the suction condition the angle formed by the surface of the blades with the axial direction of air—below referred to as inflow angle—may be adjusted within a certain range in order to increase/decrease the flow according to the actual fluid cooling requirements.

Although these apparatus, which are mainly of the fluid-dynamic type, fulfil their function, they require however special means for supplying the fluid to the blade movement devices, which means: either are not always present on the vehicles or require installation of a compressor and connection pipes, this possibility, apart from increasing the costs, is not always physically feasible.

In addition, the position of the blades at the various entry angles of the blades is unstable and requires complicated auxiliary locking elements such as counterweights or the like for opposing the thrust of the air which tends to cause rotation of the blades in the opposite direction to the direction of adjustment, resulting in undesirable and noisy angular oscillations of the blades.

U.S. Pat. No. 3,420,311 describes a system for fastening together blade and device for adjusting the inflow angle of the blade, which uses a double screw/female thread connection; in view of the imprecision which is always present in the constructional design of both the male and the female threads, the relative rotation positions the blades in a relative angular position which is not constant and definite, resulting in differences in the orientation of the blades, with a consequent reduction in the efficiency.

The technical problem which is posed therefore is that of providing a blade for fans for cooling the coolant in operating machines and/or vehicles, in particular vehicles such as agricultural tractors and off-road vehicles, which can be both easily and rapidly applied to a fan and can be controlled during rotation about its longitudinal axis.

In addition, it is specifically required that a definite and predetermined angular orientation of the fitted blade should be ensured so that all the blades are correctly and uniformly oriented once mounted on the fan, in order to avoid reducing the fluid-dynamic effects with a consequent increase in the energy consumption needed to achieve the predefined objects, both during cooling of the coolant during normal operation of the machine/vehicle and during cleaning of the cells of the radiator in the event of blockage thereof.

In connection with this problem it is also required that said blade and fan should have small dimensions, be easy and inexpensive to produce, assemble and maintain and also be able to be easily installed on any operating machine/vehicle without the need for auxiliary devices and/or complicated connection lines.

These results are achieved according to the present invention by a fan according to claim 1 and by a fan for cooling the coolant contained in the radiator of vehicles, in particular agricultural tractors and off-road vehicles, and/or operating machines according to the characteristic features of claim 7.

Figure 2:
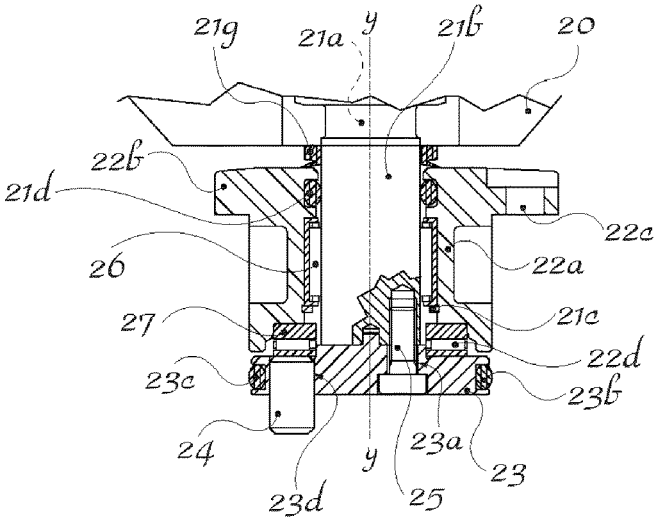
Figure 3:
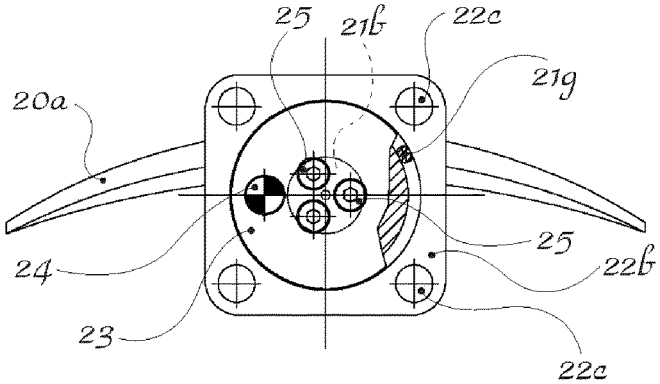
Figure 6:
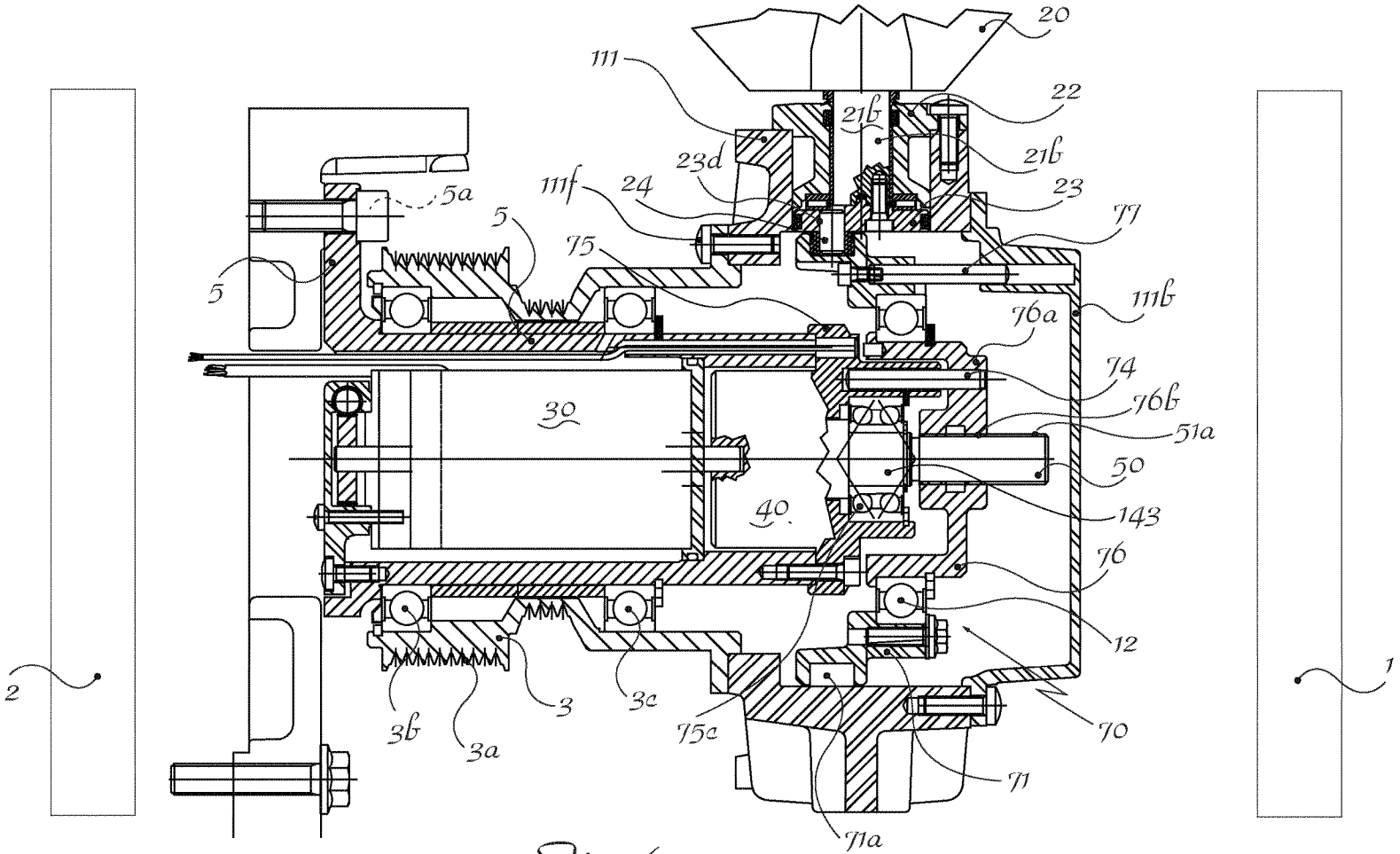

Further details may be obtained from the following description of a non-limiting example of embodiment of the subject of the present invention, provided with reference to the accompanying drawings, in which:

FIG. 1: shows an exploded view of a blade according to the present invention;

FIG. 2: shows a partial vertical section through the blade of FIG. 1 in the pre-assembled condition;

FIG. 3: shows a partially cross-sectioned view from below of the blade according to FIG. 2 in the pre-assembled condition;

FIG. 4: shows a perspective view of the blade support hub according to the present invention;

FIG. 5: shows a partial vertical section through the hub according to FIG. 3;

FIG. 6: shows an axial vertical section through an embodiment of an apparatus for actuating and controlling rotation of the blades and the fan according to the present invention;

FIG. 7: shows a perspective view of an auxiliary device for manually actuating rotation of the blades.

As shown in FIG. 1 and assuming only for the sake of easier description and without a limiting meaning a longitudinal axis X-X corresponding to the axis of rotation of a fan 10 and a radial transverse axis Y-Y as well as—with reference to the direction of travel of a vehicle indicated by the arrow "A" in FIG. 6—a front part corresponding to the position of a radiator 1 and a rear part corresponding to the position of the heat engine 2 of the vehicle, the fan 10 is arranged behind the radiator 1 and in front of the engine 2 and comprises a hub 111 which is preferably closed at the front by a cover 111*b*.

The hub 111 is axially locked to a pulley 3 for rotationally driving the fan, connected by means of a suitably driven belt 3*a* to the shaft of the heat engine 2.

The pulley 3 is mounted on a pair of bearings 3*b*,3*c* which are keyed onto a fixed support element, in the example described consisting of a tubular sleeve 5 which is fixed to the base of the engine 2 via associated means 5*a* and inside which the apparatus for controlling rotation of the blades 20, described below, is preferably partially contained.

As shown in FIGS. 1 and 2, it is envisaged that each blade 20 comprises the following pre-assembled parts:

- a shank 21 divided into:
  - a first part 21*a* with circular teeth suitable for joining—for example by means of overmoulding—to the body 20*a* of the blade, and
  - a second part situated axially on the outside of the blade body and formed as a cylindrical pin 21*b* inside which holes 21*c* with a female thread are formed;
- a blade flange 22 comprising
  - a hollow cylindrical body (22*a*), the opposite end bases of which, opposite in the transverse/radial direction Y-Y, comprise respectively:
  - a flat edge 22*b*, which is preferably polygonal and provided with through-holes 22*c* at the vertices of the polygon;
  - an inset annular seat 22*d;*
- a disk 23 provided with through-holes 23*a* and an annular seat 23*b* for receiving an anti-vibration O-ring 23*c*; the disk 23 has moreover an eccentric recess 23*d* for containing with friction a pin 24 for rotationally actuating the blade as will be described more fully below;
- screws 25 suitable for mating with the female threads in the holes 21*c* of the pin 21*b* for fixing the disk 23 to the pin 21*b;*
- means 26 for centring the shank 21*b* inside the hollow cylindrical body 22*a*; according to preferred embodiments said centring means may be realized in the form of a bush (FIG. 1) or roller bearing (FIG. 2);
- thrust bearings 27, preferably of the roller type, arranged between the disk 23 and the inset annular seat 22*c* of the blade flange 22.

Preferably the shank 21*b* is associated with a seal 21*g* designed to isolate from external forces the connection with the support flange 22.

As illustrated in the view of FIG. 3, fixing of the screws inside the holes 21*c* of the shank 21*b* of the blade causes locking of the disk 23 and relative orientation of the blade with respect to the pin 24 and via the latter also relative to the hub of the fan, as will emerge more clearly below.

By varying the relative position of the holes 21*c* relative to the pin 24 it is possible to obtain a corresponding rotation of the blade which, during pre-assembly may assume a different predefined angular rotation which is certain and stable following tightening of the screws.

According to a further aspect of the invention (FIGS. 4 and 5) it is also envisaged that the hub 111 which supports the blades 20 and is connected to the means for rotationally actuating the fan is formed as a single body with an internal axial through-seat 111*a* and radial extensions 112 with a substantially parallelepiped shape having an internal cylindrical hole 112*a* suitable for connection with the blade flange 22 which may thus be coaxially engaged on the hub to which it is fixed by means of screws 113 inserted inside the through-holes 22*c* in the flat edge 22*b* and screwed into corresponding female threads of holes 112*c* formed on the outer surface of the radial extensions 112 of the hub, against which, once assembly has been performed, the flat edge 22*b* of the flange 22 bears.

The axially opposite front surfaces 111 of the hub have respectively: holes 111*d* suitable for mating with screws for fixing a front closing cover 111*b* on the outside and holes 111*f* for performing fixing to the rotor of an apparatus for actuating and controlling rotation of the fan described below.

As shown in FIG. 6, the apparatus for controlling rotation of the blades 20 about their longitudinal axis Y-Y comprises an electric motor 30 which is coaxially inserted inside the tubular sleeve 5 and the shaft 31 of which is connected to a reduction gear 40 situated axially in front of said motor.

The kinematic output element 143 of the reduction gear is connected to a screw 50, the threading 51*a* of which is connected to the female thread 76*b* of a flange 76 retained by the inner support of a bearing 12, the outer support of which supports the device 70 for adjusting the inflow angle of the blades 20, described below.

The device 70 for adjusting the inflow angle of the said blades 20 is arranged between the bearing 12 for rotation of the hub and the shank 21*b* of the blades 20.

The device 70 preferably comprises a ring 71 fixed to the bearing 12 and provided with a radial seat 71*a* which receives the radial pin 24 engaged inside the eccentric recess 23*d* of the disk 23 fixed to the shank 21*b* of the blade 20. The ring 71 is preferably axially guided by a first rod 77 extending parallel to the axis X-X, locked to the ring 71 with which it is able to rotate and slidably inserted in an axial seat of the cover 111*b*.

A second rod 74 extends axially from a counter-plate 75 fixed to the tubular sleeve 5 and supported by a bearing 75*c* mounted on the kinematic output of the reduction gear, crossing an associated seat 76*a* passing axially through the slider 76 supported by the inner support of the bearing 12 and provided with a female thread 76*b* for engagement with the thread 51*a* of the screw 50; the slider is thus movable translatably and axially guided by the rod 74, but rotationally immobile.

The apparatus further comprises, preferably, a sensor for detecting the axial distance between the slider 76 and the reference counter-plate 75, said sensor being connected to the means—not shown—for programming and controlling rotation of the blades 20.

With this configuration of blade, hub and apparatus it is possible, once the blade has been pre-assembled with the predefined angular orientation, to arrange the ring 71 of the device 70 in a substantially central position relative to its displacement travel in both directions along the longitudinal axis X-X so that when fixing each blade on the hub, a first identical orientation of all the blades relative to the radiator is determined, for example for cooling the fluid; then, by activating the electric motor 30 which operates the device 70, it is possible to vary simultaneously the orientation in one direction or the other of all the blades so as to optimize fan efficiency, or reverse the air flow when it is required to clean the radiator.

The preferred embodiment of the single-piece hub 111 is such as to allow machine-tool machining of only the seats 112*a* which are bored with a cylindrical internal cross-section which does not have an inwardly projecting annular edge, thereby avoiding the more complex machining of both the radial and the end inner walls which join together in an axial direction the two half-parts forming the hubs according to the prior art.

This solution, in combination with the pre-assembled structure of the blade, which can be fixed to the hub as described, has the further advantage of allowing separate and independent insertion/extraction of the blades in the event of malfunctioning of one or more blades, without the need for complicated disassembly operations and openings and closures in the half-parts of the entire hub.

According to preferred modes of implementation it is also envisaged that:

the blades 20 of the fan have a radially inner part with chamfered edges—preferably symmetrical—designed to allow the rotation about the respective axis without relative interference between adjacent blades; said blades may thus rotate through angles≥180°;

The blade and the fan according to the invention are therefore able to ensure an angular orientation which is the same for all the blades, optimizing the fluid-dynamic effects with a consequent reduction in the energy consumption needed to achieve the predefined objects, as well as rapid and low-cost manoeuvres.

Although described in connection with a number of embodiments and a number of preferred examples of embodiment of the invention, it is understood that the scope of protection of the present patent is determined solely by the claims below.

The invention claimed is:

1. A pre-assembled blade assembly (20) for a cooling fan (10) for cooling the coolant contained inside a radiator (1) of operating machines and/or vehicles, comprising a blade body (20*a*) rigidly connected to an axial shank (21), wherein the shank (21) has a part axially on the outside of the blade body in the form of a cylindrical pin (21*b*), and holes (21*c*) with a female thread formed inside the pin cylindrical (21*b*), the pre-assembled blade assembly (20) further comprising:

a blade flange (22) having a hollow cylindrical body (22*a*), the opposite end bases of which comprise respectively:

a flat edge (22*b*) provided with through-holes (22*c*) connectable to a hub of the cooling fan, and an inset annular seat (22*d*);

a disk (23) provided with through-holes (23*a*) and an eccentric recess (23*d*) for stably containing with a friction an eccentric pin (24), the eccentric pin rotationally actuating the blade body about its axis;

screws (25), each screw designed to pass through a respective through-hole (23*a*) of the disk (23) and mate with the female thread of a respective hole (21*c*) in the cylindrical pin (21*b*) in order to fix relative to each other the disk (23), the blade flange (22), and the cylindrical pin (21*b*), thereby ensuring a definite angular alignment of the blade body (20*a*) relative to the eccentric pin (24) during pre-assembly.

2. The blade assembly according to claim 1, wherein said flat edge (22*b*) is polygonal and the through-holes (22*c*) of the flat edge (22*b*) are arranged at the vertices of the polygon.

3. The blade assembly according to claim 1 further comprising means (26) for centering the axial shank (21*b*) inside the hollow cylindrical body (22*a*).

4. The blade assembly according to claim 1 further comprising thrust bearings (27) arranged between the disk (23) and the inset annular seat (22*c*) of the blade flange (22).

5. The blade assembly (20) according to claim 4, wherein the thrust bearings comprise rollers.

6. The blade assembly according to claim 1, wherein said disk (23) has an annular seat (23*b*) for seating an anti-vibration O-ring (23*c*).

7. The blade assembly according to claim 1 further comprising an isolating seal (21*c*) arranged between the shank and the blade support flange (22).

8. A cooling fan (10) for cooling the coolant contained inside a radiator (1) of operating machines and/or vehicles, comprising:

one or more blade assemblies (20); and a hub (111) of the cooling fan (10) that can be rotationally operated about an axis (X-X) thereof and is realized as a single body with an internal axial through-seat (111*a*) and radial extensions (112), wherein at least one of said blade assemblies (20) is rotatable about an axis perpendicular to the axis (X-X) of rotation of the hub (111), the at least one blade assembly comprising:

a blade body (20*a*) rigidly connected to an axial shank (21), wherein the shank (21) has a part axially on the outside of the blade body in the form of a cylindrical pin (21*b*), and holes (21*c*) with a female thread formed inside the pin cylindrical (21*b*);

a blade flange (22) having a hollow cylindrical body (22*a*), the opposite end bases of which comprise respectively:

a flat edge (22*b*) provided with through-holes (22*c*) connectable to the hub of the cooling fan, and an inset annular seat (22*d*);

a disk (23) provided with through-holes (23*a*) and an eccentric recess (23*d*) for stably containing with a friction an eccentric pin (24), the eccentric pin rotationally actuating the blade body about its axis;

screws (25), each screw designed to pass through a respective through-hole (23*a*) of the disk (23) and mate with the female thread of a respective hole (21*c*) in the cylindrical pin (21*b*) in order to fix relative to each other the disk (23), the blade flange (22), and the cylindrical pin (21*b*), thereby ensuring a definite angular alignment of the blade body (20*a*) relative to the eccentric pin (24), wherein said radial extensions (112) of the hub have a substantially parallelepiped shape having an internal cylindrical hole (112*a*) suitable for coaxial engagement with the shank of the blade assembly (20) and for connection to the blade flange (22), and wherein said radial extensions (112) of the hub (111) also have holes (112*c*) with a female thread for mating with screws (123) in order to fix the blade flange (22) of the blade assembly (20).

9. The cooling fan according to claim 8, wherein the axially opposite front surfaces of the hub have respectively:

holes (111*d*) suitable for mating with screws for fixing a front closing cover (111*b*) on the outside, and holes (111*f*) for performing fixing to the rotor of an apparatus for actuating and controlling rotation of the fan.

10. The cooling fan according to claim 8, wherein the screws for fixing the blade to the hub pass, during use, through the holes (22*c*) in the flat edge (22*b*) of the blade flange (22).

* * * * *